US010915042B2

(12) United States Patent
Iketani

(10) Patent No.: US 10,915,042 B2
(45) Date of Patent: Feb. 9, 2021

(54) TONER CONVEYANCE DEVICE, CLEANING DEVICE AND IMAGE FORMING APPARATUS

(71) Applicant: KYOCERA Document Solutions Inc., Osaka (JP)

(72) Inventor: Takeshi Iketani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/847,302

(22) Filed: Apr. 13, 2020

(65) Prior Publication Data

US 2020/0341406 A1 Oct. 29, 2020

(30) Foreign Application Priority Data

Apr. 26, 2019 (JP) ..... 2019-085438

(51) Int. Cl.
*G03G 15/095* (2006.01)
*G03G 15/08* (2006.01)

(52) U.S. Cl.
CPC ..... *G03G 15/095* (2013.01); *G03G 15/0891* (2013.01)

(58) Field of Classification Search
CPC ..... G03G 15/095; G03G 15/0891
See application file for complete search history.

(56) References Cited

U.S. PATENT DOCUMENTS 10,268,155 B2 4/2019 Otomura et al.
2011/0229213 A1* 9/2011 Mihara ..... G03G 15/0879 399/263
2014/0219688 A1* 8/2014 Murata ..... G03G 15/0877 399/258

FOREIGN PATENT DOCUMENTS

JP 2017-227700 A 12/2017

* cited by examiner

*Primary Examiner* — Victor Verbitsky
(74) *Attorney, Agent, or Firm* — Studebaker & Brackett PC

(57) ABSTRACT

A toner conveyance device includes a housing and a conveyance member. The conveyance member includes a conveyance shaft and a conveyance blade. The conveyance blade includes a first blade part, a second blade part and a third blade part. The first blade part is formed along a predetermined spiral direction. The second blade part is connected to the first blade part on a downstream side of the first blade part in a conveyance direction and extends along the conveyance direction. The third blade part is connected to the second blade part on a downstream side of the second blade part in the conveyance direction and formed along a spiral direction opposite to the spiral direction of the first blade part. A boundary between the first blade part and the second blade part is contained within a range of a toner discharge port in the conveyance direction.

9 Claims, 5 Drawing Sheets

TONER CONVEYANCE DEVICE, CLEANING DEVICE AND IMAGE FORMING APPARATUS

INCORPORATION BY REFERENCE

This application is based on and claims the benefit of priority from Japanese patent application No. 2019-085438 filed on Apr. 26, 2019, which is incorporated by reference in its entirety.

BACKGROUND

The present disclosure relates to a toner conveyance device, a cleaning device and an image forming apparatus.

An electrophotographic type image forming apparatus includes a toner conveyance device which conveys a toner supplied to an image carrier (for example, a photosensitive drum and an intermediate transferring belt) or conveys a waste toner collected from the image carrier.

For example, the toner conveyance device includes a housing having a toner conveyance path and a toner discharge port, and a conveyance member conveying the toner in the toner conveyance path toward the toner discharge port. The above conveyance member includes a spiral conveyance blade, for example.

In the above toner conveyance member, because the spiral blade is continuously formed from the upstream side to the downstream side of the toner discharge port in the toner conveyance direction, the toner is conveyed to the downstream side of the toner discharge port with a large force. Then, the toner is accumulated on the downstream side of the toner discharge port in the toner conveyance direction. If the accumulated toner is aggregated, a rotational failure of the conveyance member may occur. If such a rotational failure of the conveyance member occurs, it becomes impossible to convey the toner stably by the conveyance member.

SUMMARY

In accordance with an aspect of the present disclosure, a toner conveyance device includes a housing and a conveyance member. The housing has a toner conveyance path and a toner discharge port. The conveyance member rotates in a predetermined rotational direction to convey a toner in the toner conveyance path to the toner discharge port along a predetermined conveyance direction. The conveyance member includes a conveyance shaft and a conveyance blade. The conveyance shaft extends along the conveyance direction. The conveyance blade protrudes from an outer circumferential face of the conveyance shaft. The conveyance blade includes a first blade part, a second blade part and a third blade part. The first blade part is formed along a predetermined spiral direction. The second blade part is connected to the first blade part on a downstream side of the first blade part in the conveyance direction and extends along the conveyance direction. The third blade part is connected to the second blade part on a downstream side of the second blade part in the conveyance direction and formed along a spiral direction opposite to the spiral direction of the first blade part. A boundary between the first blade part and the second blade part is contained within a range of the toner discharge port in the conveyance direction.

In accordance with an aspect of the present disclosure, a cleaning device includes a cleaning member and the toner conveyance device. The cleaning member removes a waste toner remaining on a surface of an image carrier. The toner conveyance device conveys the waste toner removed by the cleaning member.

In accordance with an aspect of the present disclosure, an image forming apparatus includes the toner conveyance device or the cleaning device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
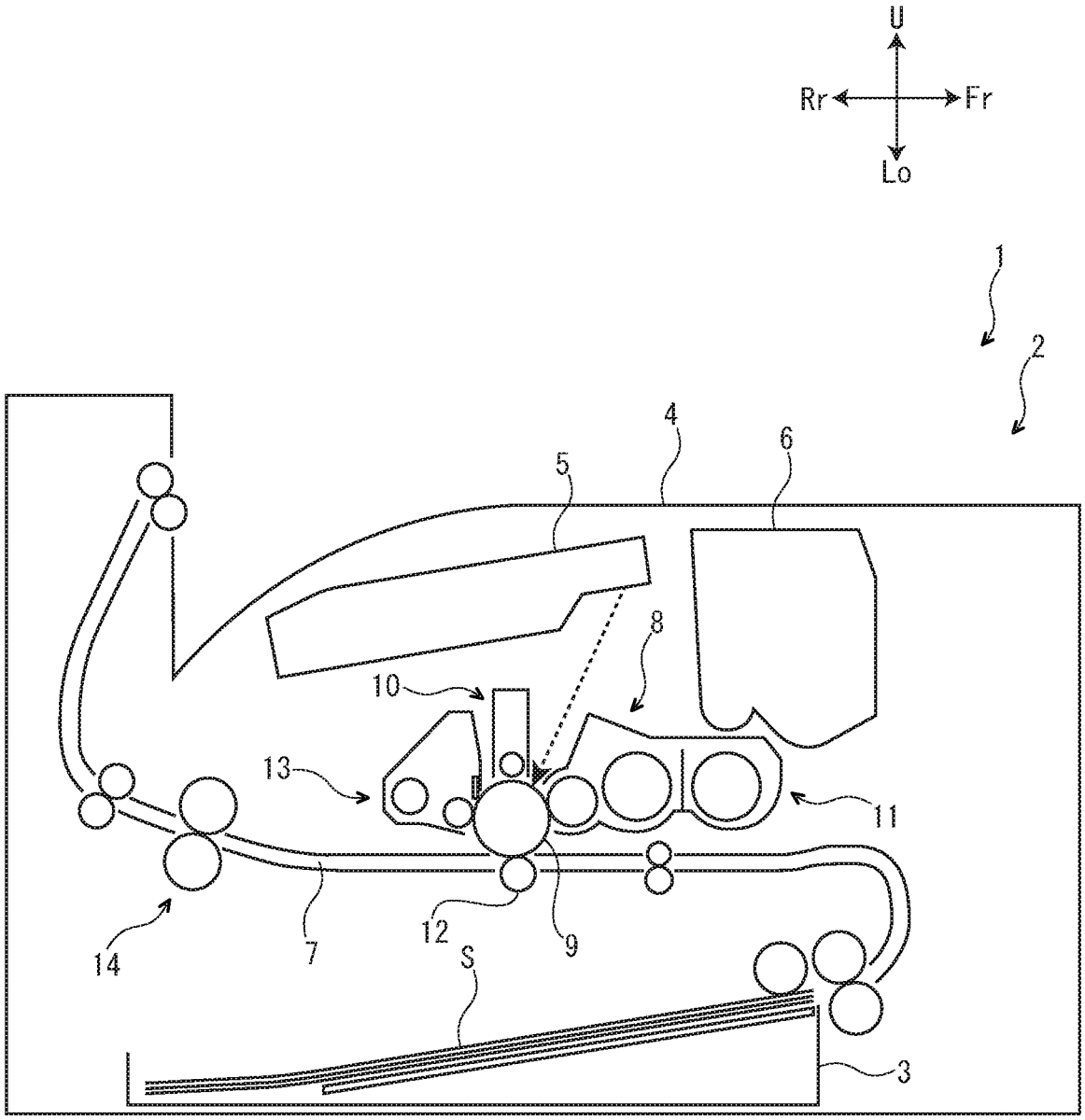
FIG. 1 is a side view schematically showing an image forming apparatus according to one embodiment of the present disclosure.

Hereinafter, an image forming apparatus 1 according to one embodiment of the present disclosure will be described with reference to the drawings. For convenience of explanation, a right side on a paper surface of FIG. 1 is defined as a front side of the image forming apparatus 1. Arrows Fr, Rr, U, Lo, L and R marked in each figure respectively show a front side, a rear side, an upper side, a lower side, a left side and a right side of the image forming apparatus 1.

Firstly, an entire structure of the image forming apparatus 1 will be described.

With reference to FIG. 1, the image forming apparatus 1 is a printer, for example. The image forming apparatus 1 includes a box-like shaped apparatus main body 2. In the lower end portion of the apparatus main body 2, a sheet feeding cassette 3 storing a sheet S (an example of a recording medium) is stored. On the upper face of the apparatus main body 2, a discharge tray 4 is provided. In the upper portion of the apparatus main body 2, an exposure device 5 and a toner container 6 are stored below the discharge tray 4.

Inside the apparatus main body 2, a sheet conveyance path 7 is provided from the sheet feeding cassette 3 to the discharge tray 4. At the midstream portion of the sheet conveyance path 7, an image forming part 8 is provided. The image forming part 8 includes a photosensitive drum 9 (an example of an image carrier), a charging device 10, a development device 11, a transferring roller 12 and a cleaning device 13. At the downstream portion of the sheet conveyance path 7, a fixing device 14 is provided.

Next, a printing operation of the image forming apparatus 1 will be described.

Firstly, the charging device 10 charges the surface of the photosensitive drum 9. Next, the exposure device 5 emits light (refer to the dotted line arrow in FIG. 1) to form an electrostatic latent image on the surface of the photosensitive drum 9. Then, the development device 11 develops the electrostatic latent image on the surface of the photosensitive drum 9. Thereby, a toner image is carried on the surface of the photosensitive drum 9.

On the other hand, the sheet S fed from the sheet feeding cassette 3 is conveyed downstream along the sheet conveyance path 7, and enters the image forming part 8. The transferring roller 12 transfers the toner image from the surface of the photosensitive drum 9 to the sheet S. The sheet S to which the toner image is transferred enters the fixing device 14. The fixing device 14 fixes the toner image on the sheet S. The sheet S on which the toner image is fixed is discharged on the discharge tray 4.

Next, the cleaning device 13 will be further described.

Figure 2:
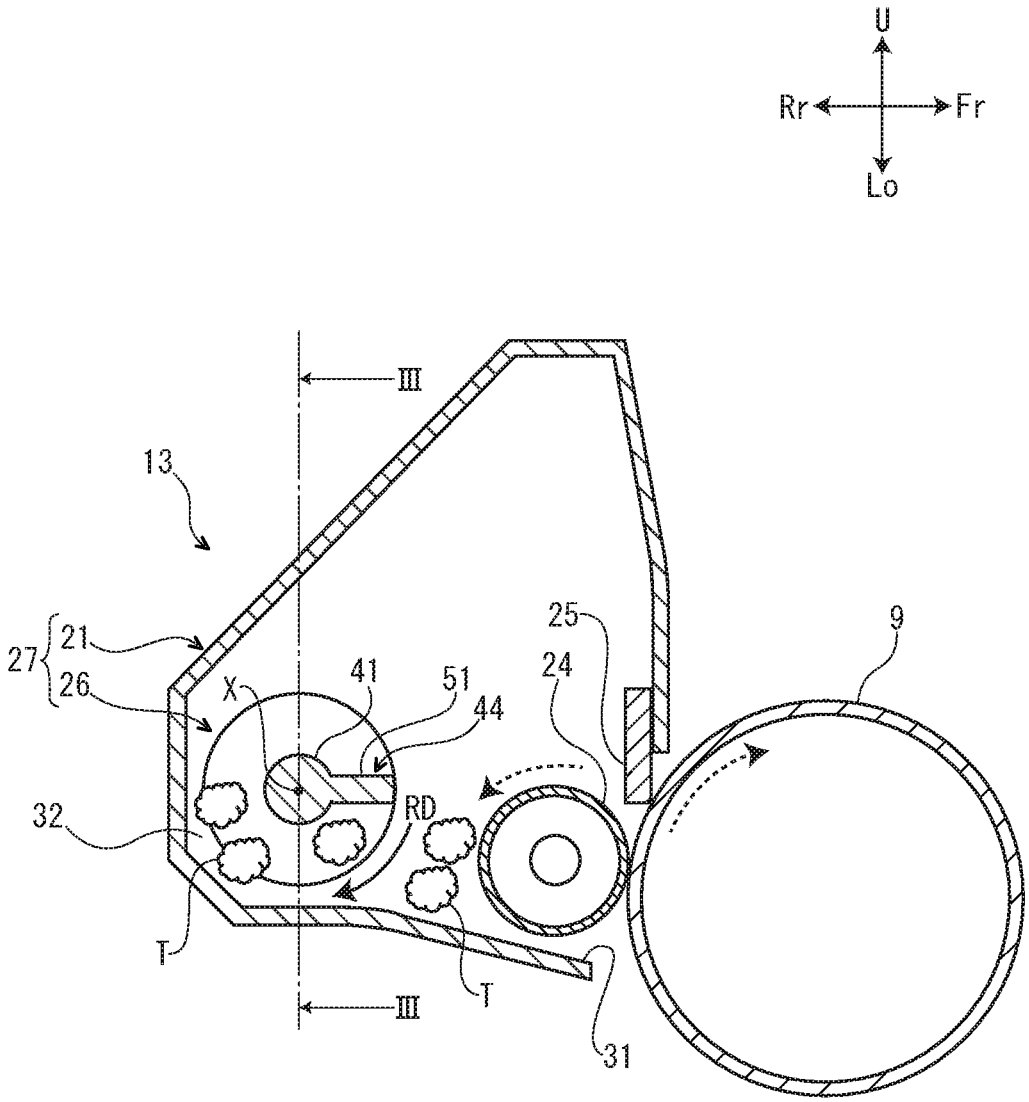
FIG. 2 is a sectional view showing a photosensitive drum and a cleaning device in the image forming apparatus according to the embodiment of the present disclosure.
Figure 3:
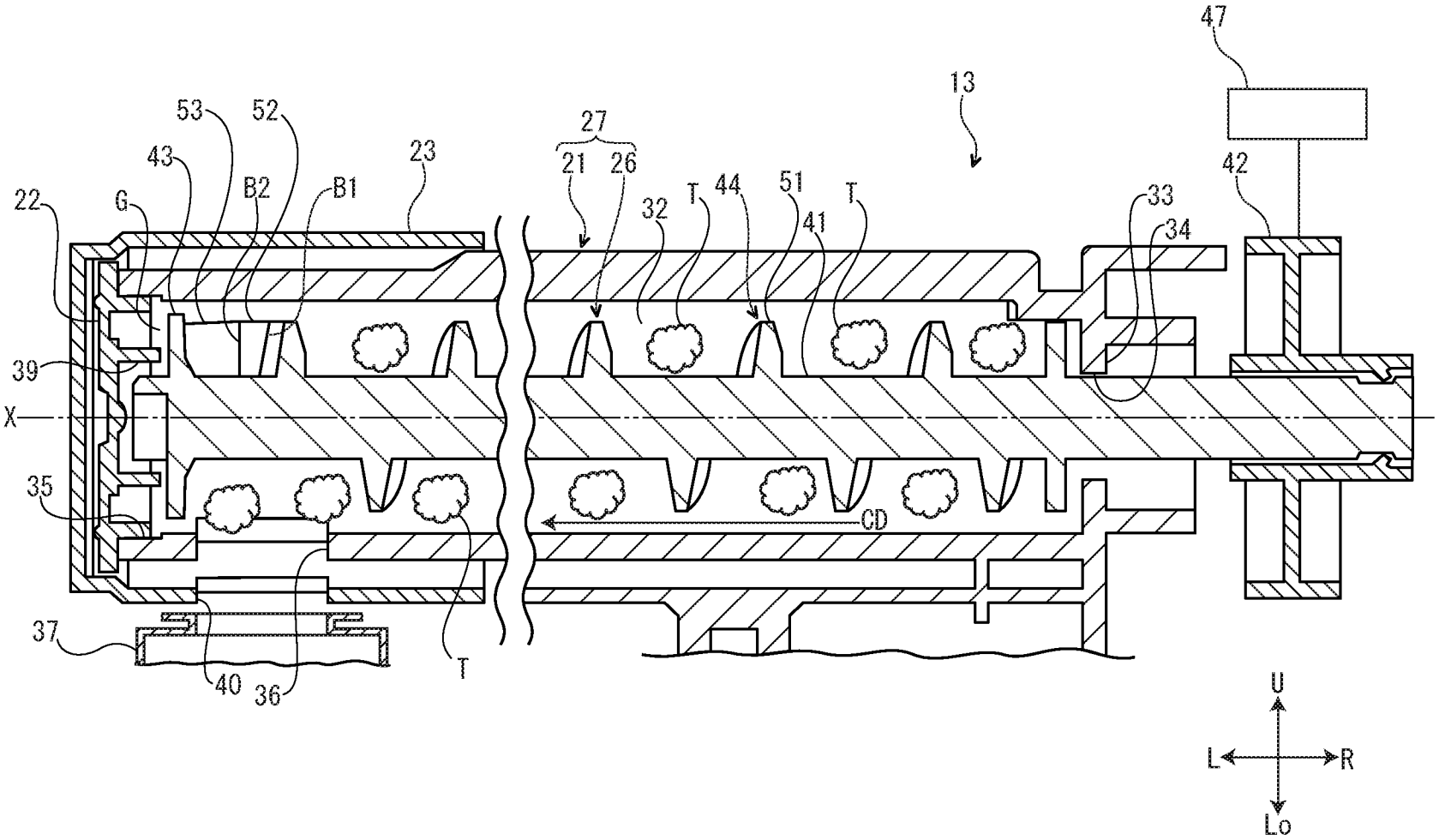
FIG. 3 is a sectional view taken along the line III-III in FIG. 2.

With reference to FIG. 2 and FIG. 3, the cleaning device 13 includes a housing 21, a cap 22, a shutter 23, a cleaning roller 24 (an example of a cleaning member), a cleaning blade 25 (an example of a cleaning member) and a conveyance member 26. The housing 21 and the conveyance member 26 constitutes a toner conveyance device 27. Hereinafter, the components of the cleaning device 13 will be described in order.

Figure 4:
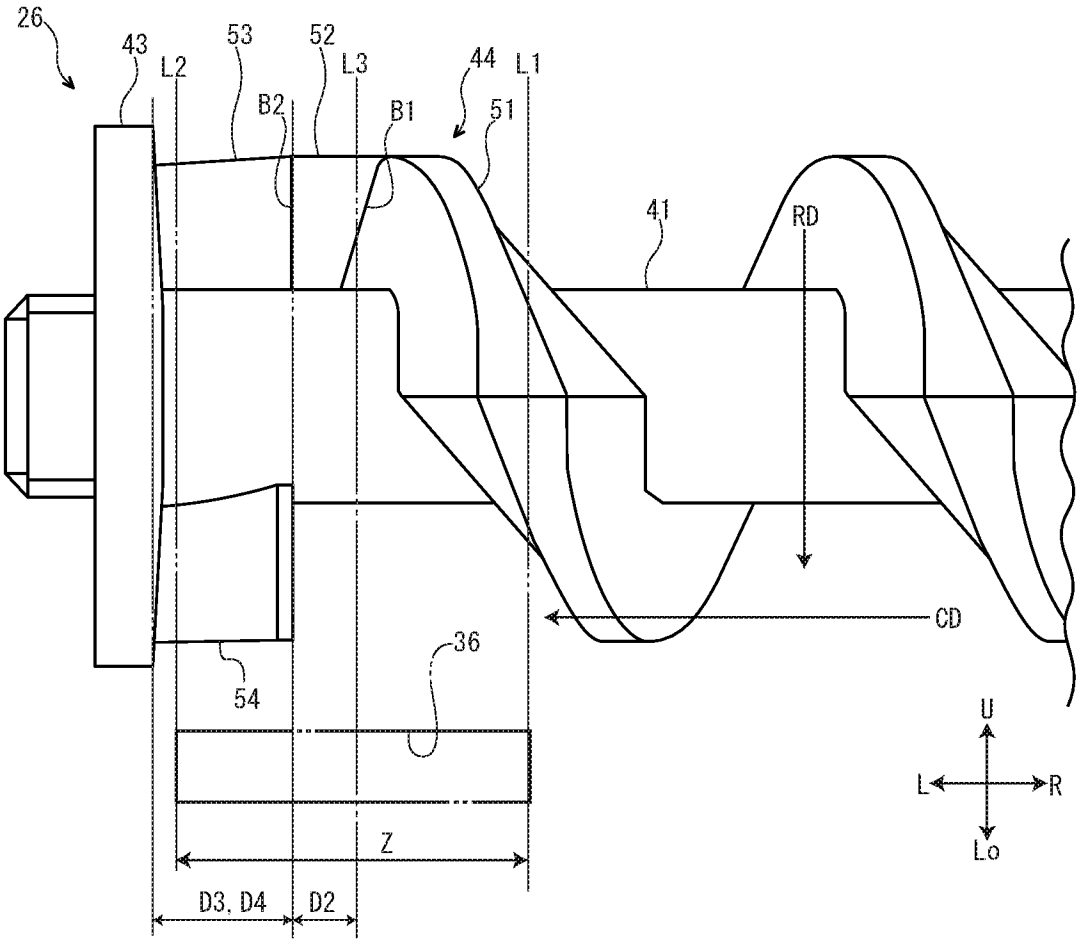
FIG. 4 is a side view showing a second blade part positioned just above a conveyance shaft, in the image forming apparatus according to the embodiment of the present disclosure.
Figure 5:
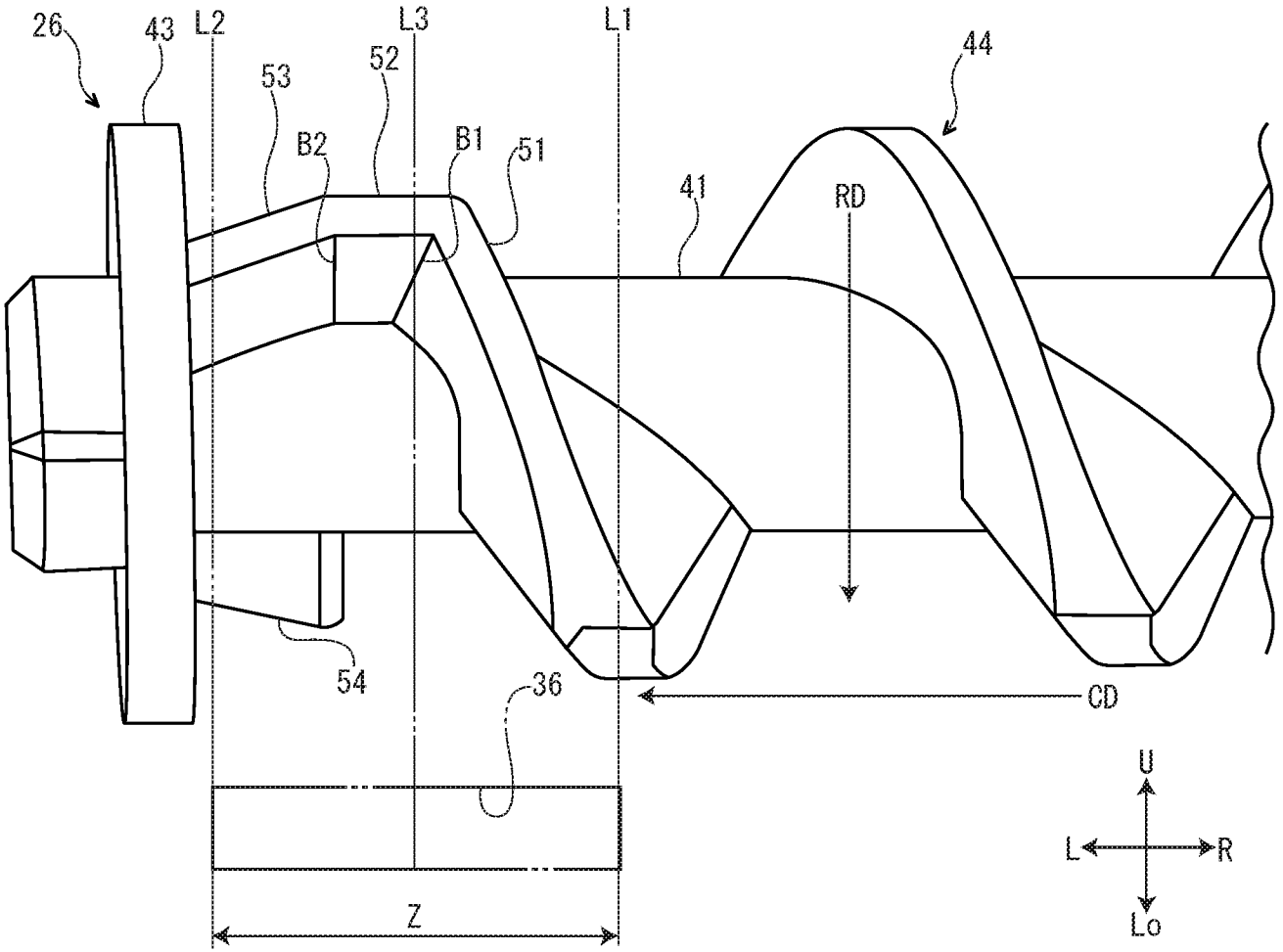
FIG. 5 is a side view showing the second blade part positioned on a front upper side of the conveyance shaft, in the image forming apparatus according to the embodiment of the present disclosure.

With reference to FIG. 2 and FIG. 3, the housing 21 of the cleaning device 13 has a box-like shape long in the left-and-right direction. In the front lower portion of the housing 21, a front side opening 31 is provided. In the rear lower portion of the housing 21, a toner conveyance path 32 is provided. The toner conveyance path 32 extends along the left-and-right direction. The arrow CD marked in FIG. 3 to FIG. 5 shows a conveyance direction of the toner in the toner conveyance path 32 (hereinafter, called "a conveyance direction CD"). In the present embodiment, the conveyance direction CD is a direction from the right side to the left side along the left-and-right direction. Hereinafter, "an upstream side in the conveyance direction" shows an upstream side in the conveyance direction CD and "a downstream side in the conveyance direction" shows a downstream side in the conveyance direction CD.

With reference to FIG. 2, in the right end portion (the end portion on the upstream side in the conveyance direction) of the housing 21, a support wall 33 is provided on a right side of the toner conveyance path 32. In the center portion of the support wall 33, a through hole 34 is provided. In the left end portion (the end portion on the downstream side in the conveyance direction) of the housing 21, a left side opening 35 is provided on a left side of the toner conveyance path 32. In the lower face of the housing 21, a toner discharge port 36 is provided below the left end portion (the end portion on the downstream side in the conveyance direction) of the toner conveyance path 32. Below the toner discharge port 36, a collection container 37 is provided.

With reference to FIG. 3, the cap 22 of the cleaning device 13 has a circular plate-like shape. The cap 22 is fixed to the left end portion of the housing 21, and closes the left side opening 35 of the housing 21. On the center portion of the right face (the inner face) of the cap 22, a cylindrical supporting portion 39 is protruded.

With reference to FIG. 3, the shutter 23 of the cleaning device 13 has a cylindrical shape having a closed bottom which closes the left end portion (the end portion on the downstream side in the conveyance direction). The shutter 23 is rotatably attached around the outer circumference of the left end portion of the housing 21. In the outer circumference of the shutter 23, a communication port 40 is provided. The shutter 23 is rotatable between an open position where the shutter 23 communicates the communication port 40 with the toner discharge port 36 to open the toner discharge port 36 (refer to FIG. 3) and a close position where the shutter 23 does not communicate the communication port 40 with the toner discharge port 36 to close the toner discharge port 36 (not shown).

With reference to FIG. 2, the cleaning roller 24 of the cleaning device 13 is rotatable. The cleaning roller 24 is stored in the front lower portion of the housing 21. The cleaning roller 24 is exposed to an outside of the housing 21 through the front side opening 31 of the housing 21 and comes into contact with the surface of the photosensitive drum 9.

With reference to FIG. 2, the cleaning blade 25 of the cleaning device 13 has a plate-like shape long in the left-and-right direction. The upper portion of the cleaning blade 2 is fixed to the front lower portion of the housing 21. The lower portion of the cleaning blade 25 is exposed to an outside of the housing 21 through the front side opening 31 of the housing 21 and comes into contact with the surface of the photosensitive drum 9.

With reference to FIG. 2 and FIG. 3, the conveyance member 26 of the cleaning device 13 is rotatable around a rotational axis X extending along the left-and-right direction. That is, the left-and-right direction is a rotational axial direction of the conveyance member 26. The arrow RD marked in FIG. 2, FIG. 4 and FIG. 5 shows a rotational direction of the conveyance member 26 (hereinafter, called "a rotational direction RD"). Hereinafter, "an upstream side in the rotational direction" shows an upstream side in the rotational direction RD and "a downstream side in the rotational direction" shows a downstream side in the rotational direction RD.

With reference to FIG. 2 and FIG. 3, the conveyance member 26 has a conveyance shaft 41, a conveyance gear 42, a flange 43 and a conveyance blade 44. The conveyance shaft 41, the flange 43 and the conveyance blade 44 are formed integrally.

The conveyance shaft 41 of the conveyance member 26 extends linearly along the conveyance direction CD. The right end portion (the end portion on the upstream side in the conveyance direction) of the conveyance shaft 41 is exposed to an outside of the housing 21, the portion other than the right end portion is stored in the toner conveyance path 32. The right side portion (the portion on the upstream side in the conveyance direction) of the conveyance shaft 41 penetrates the through hole 34 of the support wall 33 of the housing 21, and is rotatably supported by the support wall 33 of the housing 21 via a bearing (not shown). The left end portion (the end portion on the downstream side in the conveyance direction) of the conveyance shaft 41 is inserted into the supporting portion 39 of the cap 22 and rotatably supported by the supporting portion 39 of the cap 22.

The conveyance gear 42 of the conveyance member 26 is exposed to an outside of the housing 21. The conveyance gear 42 is fixed to the outer circumference of the right end portion of the conveyance shaft 41. The conveyance gear 42 is connected to a driving source 47 containing a motor.

The flange 43 of the conveyance member 26 has an annular shape. The flange 43 is stored in the toner conveyance path 32. The flange 43 protrudes from the outer circumferential face of the conveyance shaft 41 on a left side (the downstream side in the conveyance direction) of the conveyance blade 44. The flange 43 is disposed on a left side (the downstream side in the conveyance direction) of the toner discharge port 36. The flange 43 is disposed on a right side (the upstream side in the conveyance direction) of the cap 22 and faces the cap 22 at an interval G.

The conveyance blade 44 of the conveyance member 26 is stored in the toner conveyance path 32. The conveyance blade 44 protrudes from the outer circumferential face of the conveyance shaft 41.

With reference to FIG. 3 to FIG. 5, the conveyance blade 44 has a first blade part 51, a second blade part 52, a third blade part 53 and a fourth blade part 54.

The first blade part 51 of the conveyance blade 44 has a spiral shape, and is formed continuously from the right end portion (the end portion on the upstream side in the conveyance direction) to the left end portion (the end portion on the downstream side in the conveyance direction) of the toner conveyance path 32. The first blade part 51 is formed along a predetermined spiral direction so as to convey the toner to the downstream side in the conveyance direction (is inclined toward the downstream side in the conveyance direction to the upstream side in the rotational direction).

The second blade part 52 of the conveyance blade 44 is formed continuously to the first blade part 5 on a left side (the downstream side in the conveyance direction) of the first blade part 51. The second blade part 52 extends linearly along the conveyance direction CD, and is parallel to the conveyance direction CD.

The whole of the second blade part 52 of the conveyance blade 44 is disposed on a left side (the downstream side in the conveyance direction) of a vertical line L1 passing the right end portion (the end portion on the upstream side in the conveyance direction) of the toner discharge port 36 and on a right side (the upstream side in the conveyance direction) of a vertical line L2 passing the left end portion (the end portion on the downstream side in the conveyance direction) of the toner discharge port 36. That is, the whole of the second blade part 52 is contained within a range Z of the toner discharge port 36 in the conveyance direction CD. The second blade part 52 has a length D2 in the conveyance direction CD equal to or smaller than a half of a length of the toner discharge port 36 in the conveyance direction CD, for example (in the present embodiment, the second blade part 52 has a length approximately equal to ¼ of a length of the toner discharge port 36).

The third blade part 53 of the conveyance blade 44 is formed continuously to the second blade part 52 on a left side (the downstream side in the conveyance direction) of the second blade part 52. The left end portion (the end portion on the downstream side in the conveyance direction) of the third blade part 53 is connected to the flange 43.

The third blade part 53 of the conveyance blade 44 is formed along a spiral direction opposite to the spiral direction of the first blade part 51 (is inclined toward the downstream side in the conveyance direction to the downstream side in the rotational direction). That is, the third blade part 53 is inclined to an opposite side to the first blade part 51. The third blade part 53 has an inclined angle to the conveyance direction CD smaller than an inclined angle of the first blade part 51 to the conveyance direction CD. The third blade part 53 has a length D3 in the conveyance direction CD longer than a length D2 of the second blade part 52 in the conveyance direction CD.

The fourth blade part 54 is provided on an opposite side to the third blade part 53 with respect to the rotational axis X. The fourth blade part 54 is provided at a position shifted in phase by 180 degrees from the third blade part 53 in the circumferential direction. The left end portion (the end portion on the downstream side in the conveyance direction) of the fourth blade part 54 is connected to the flange 43.

The fourth blade part 54 of the conveyance blade 44 is formed along a spiral direction opposite to the spiral direction of the first blade part 51 (is inclined toward the downstream side in the conveyance direction to the downstream side in the rotational direction). That is, the fourth blade part 54 is inclined in an opposite direction to the first blade part 51 and in the same direction as the third blade part 53. The fourth blade part 54 has an inclined angle to the conveyance direction CD smaller than an inclined angle of the first blade part 51 to the conveyance direction CD and equal to an inclined angle of the third blade part 53 to the conveyance direction CD. The fourth blade part 54 has a length D4 in the conveyance direction CD longer than a length D2 of the second blade part 52 in the conveyance direction CD and is equal to a length D3 of the third blade part 53 in the conveyance direction CD.

A boundary B1 between the first blade part 51 and the second blade part 52 of the conveyance blade 44 is disposed on a left side (the downstream side in the conveyance direction) of the vertical line L1 passing the right end portion (the end portion on the upstream side in the conveyance direction) of the toner discharge port 36 and on a right side (the upstream side in the conveyance direction) of the vertical line L2 passing the left end portion (the end portion on the downstream side in the conveyance direction) of the toner discharge port 36. That is, the boundary B1 is contained within the range Z of the toner discharge port 36 in the conveyance direction CD. Th boundary B1 is positioned on a vertical line L3 passing the center portion of the toner discharge port 36 in the conveyance direction CD. That is, the boundary B1 is overlapped with the center portion of the toner discharge port 36 in the conveyance direction CD.

A boundary B2 between the second blade part 52 and the third blade part 53 of the conveyance blade 44 is disposed on a left side (the downstream side in the conveyance direction) of the vertical line L1 passing the right end portion (the end portion on the upstream side in the conveyance direction) of the toner discharge port 36 and on a right side (the upstream side in the conveyance direction) of the vertical line L2 passing the left end portion (the end portion on the downstream side in the conveyance direction) of the toner discharge port 36. That is, the boundary B1 is contained within the range Z of the toner discharge port 36 in the conveyance direction CD.

In the image forming apparatus 1 having the above described configuration, after the toner image carried on the surface of the photosensitive drum 9 is transferred on the sheet S by the transferring roller 12, the waste toner T remains on the surface of the photosensitive drum 9. Hereinafter, an operation to collect the waste toner T from the surface of the photosensitive drum 9 by the cleaning device 13 (hereinafter, called "a waste toner collection operation") will be described.

When the waste toner collection operation is performed, the photosensitive drum 9 and the cleaning roller 24 are rotated with the photosensitive drum 9 coming into contact with the cleaning roller 24 (refer to the dotted line arrow in FIG. 2). Then, the waste toner T is removed from the surface of the photosensitive drum 9 by the cleaning roller 24 and then introduced into the toner conveyance path 32.

At the performing of the waste toner collection operation, the photosensitive drum 9 is rotated with respect to the cleaning blade 25 with the photosensitive drum 9 coming into contact with the cleaning blade 25 (refer to the dotted line arrow in FIG. 2). Then, the waste toner T is removed from the surface of the photosensitive drum 9 by the cleaning blade 25 and then introduced into the toner conveyance path 32.

At the performing of the waste toner collection operation, the driving source 47 rotates the conveyance member 26 in the rotational direction RD. When the conveyance member 26 is rotated in the rotational direction RD, the conveyance member 26 conveys the waste toner T in the conveyance path 32 to the toner discharge port 36 along the conveyance direction CD. The waste toner T conveyed to the toner discharge port 36 by the conveyance member 26 is discharged to an outside of the housing 21 through the toner discharge port 36 and then collected in the collection container 37.

By the way, in the above waste toner collection operation, when the waste toner T passed through an upper space of the toner discharge port 36 is conveyed to a gap G between the cap 22 and the flange 43 and then accumulated there, the accumulated waste toner T may be aggregated to cause rotational failure of the conveyance member 26. Especially, when the toner discharge port 36 has a small opening area, the waste toner T easily passes through the upper space of the toner discharge port 36, and the above rotational failure may easily occur.

Then, in the present embodiment, the conveyance blade 44 has the spiral first blade part 51, the second blade part 52 extending along the conveyance direction CD and the third blade part 53 inclined in an opposite direction to the first blade part 51, and the boundary B1 between the first blade part 51 and the second blade part 52 is contained within the range Z of the toner discharge port 36 in the conveyance direction CD. By applying such a configuration, the waste toner T is applied with a force in a direction opposite to the conveyance direction CD so that it becomes possible to inhibit the waste toner T from being passed through the upper space of the toner discharge port 36. Furthermore, the second blade part 52 efficiently conveys the waste toner T to the toner discharge port 36 so that it becomes possible to promote the discharging of the waste toner T through the toner discharge port 36. Thereby, it becomes possible to inhibit the waste toner T passed through the upper space of the toner discharge port 36 from being conveyed to the gap G and then accumulated there. As a result, it becomes possible to inhibit the rotational failure of the conveyance member 26 owing to the aggregation of the waste toner T and to convey the waste toner T by the conveyance member 26 stably.

The boundary B1 between the first blade part 51 and the second blade part 52 is overlapped with the center portion of the toner discharge port 36 in the conveyance direction CD. By applying such a configuration, the second blade part 52 makes it possible to convey the waste toner T to the toner discharge port 36 more efficiently.

The boundary B2 between the second blade part 52 and the third blade part 53 is contained within the range Z of the toner discharge port 36 in the conveyance direction CD. By applying such a configuration, it becomes possible to discharge the waste toner T applied with a force in a direction opposite to the conveyance direction CD through the toner discharge port 36 smoothly.

The fourth blade part 54 is inclined in a direction opposite to the first blade part 51. By applying such a configuration, it becomes possible to apply a force in a direction opposite to the conveyance direction to the waste toner T not only by the third blade part 53 but also by the fourth blade part 54.

The fourth blade part 54 is provided on an opposite side to the third blade part 53 to the rotational axis X of the conveyance member 26. By applying such a configuration, it becomes possible to optimize a force applied to the waste toner T in a direction opposite to the conveyance direction CD by the fourth blade part 54.

The third blade part 53 has a length in the conveyance direction CD longer than a length of the second blade part 52 in the conveyance direction CD. By applying such a configuration, it becomes possible to apply a force in a direction opposite to the conveyance direction CD to the waste toner T by the third blade part 53 easily.

The third blade part 53 has an inclined angle to the conveyance direction CD smaller than an inclined angle of the first blade part 51 to the conveyance direction CD. By applying such a configuration, it becomes possible to suppress a force applied to the waste toner T in a direction opposite to the conveyance direction CD from being excessive and to inhibit the waste toner T from being reversely conveyed to the upstream side of the toner discharge port 36 in the conveyance direction CD.

The end portion of the third blade part 53 in the conveyance direction is connected to the flange 43. By applying such a configuration, the end portion of the third blade part 53 in the conveyance direction can be disposed as close as possible to the gap P so that it becomes possible to inhibit the waste toner T from being conveyed to the gap G more efficiently.

The cleaning device 13 includes the cleaning roller 24 and the cleaning blade 25 which remove the waste toner T remaining on the surface of the photosensitive drum 9, and the toner conveyance device 27 which conveys the waste toner T removed by the cleaning roller 24 and the cleaning blade 25. By applying such a configuration, it becomes possible to provide the cleaning device 1 capable of conveying the waste toner T stably.

The image forming apparatus 1 includes the toner conveyance device 27 and the cleaning device 13 provided with the toner conveyance device 27. By applying such a configuration, it becomes possible to provide the image forming apparatus 1 capable of conveying the waste toner T stably.

In the present embodiment, the second blade part 52 is parallel to the conveyance direction CD. On the other hand, in other embodiments, the second blade part 52 may be inclined slightly to the conveyance direction CD.

In the present embodiment, the second blade part 52 has a length in the conveyance direction CD equal to or smaller than a half of a length of the toner discharge port 36 in the conveyance direction CD. On the other hand, in other embodiments, the second blade part 52 has a length in the conveyance direction CD larger than a half of a length of the toner discharge port 36 in the conveyance direction CD.

In the present embodiment, the conveyance blade 44 has one fourth blade part 54. On the other hand, in other embodiments, two or more second blade parts 2 may be provided, or the conveyance blade 44 may not have the fourth blade part 54.

In the present embodiment, the toner conveyance device 27 is provided on the path through which the waste toner T is collected from the photosensitive drum 9. On the other hand, in other embodiments, the toner conveyance device 27 may be provided on a path through which the toner is supplied to the photosensitive drum 9.

In the present embodiment, the image forming apparatus 1 is a printer. On the other hand, in other embodiments, the image forming apparatus 1 may be a copying machine, a facsimile, a multifunctional peripheral (an apparatus containing a printing function, a copying function and a facsimile function totally).

The invention claimed is:

1. A toner conveyance device comprising:

a housing having a toner conveyance path and a toner discharge port; and a conveyance member rotating in a predetermined rotational direction to convey a toner in the toner conveyance path to the toner discharge port along a predetermined conveyance direction, wherein the conveyance member includes:

a conveyance shaft extending along the conveyance direction; and a conveyance blade protruding from an outer circumferential face of the conveyance shaft, the conveyance blade includes:

a first blade part formed along a predetermined spiral direction so as to convey the toner to the toner discharge port along the conveyance direction;

a second blade part connected to the first blade part on a downstream side of the first blade part in the conveyance direction and extending along the conveyance direction; and a third blade part connected to the second blade part on a downstream side of the second blade part in the conveyance direction and formed so as to apply a force in a direction opposite to the conveyance direction to the toner, and a fourth blade part provided on a downstream side of the second blade part in the conveyance direction at a position displaced in phase by 180 degrees from the third blade part in a circumferential direction of the conveyance shaft and formed so as to apply a force in the direction opposite to the conveyance direction, wherein a boundary between the first blade part and the second blade part is contained within a range of the toner discharge port in the conveyance direction.

2. The toner conveyance device according to claim 1, wherein the boundary between the first blade part and the second blade part is overlapped with a center portion of the toner discharge port in the conveyance direction.

3. The toner conveyance device according to claim 1, wherein a boundary between the second blade part and the third blade part is contained within the range of the toner discharge port in the conveyance direction.

4. The toner conveyance device according to claim 1, wherein the third blade part has a length in the conveyance direction longer than a length of the second blade part in the conveyance direction.

5. The toner conveyance device according to claim 1, wherein a length of the fourth blade part in the conveyance direction is equal to a length of the third blade part in the conveyance direction.

6. The toner conveyance device according to claim 1, wherein the third blade part has an inclined angle with respect to the conveyance direction smaller than an inclined angle of the first blade part with respect to the conveyance direction.

7. The toner conveyance device according to claim 1, wherein the conveyance member further includes an annular flange protruding from the outer circumferential face of the conveyance shaft on a downstream side of the conveyance blade in the conveyance direction, and an end portion of the third blade part in the conveyance direction is connected to the flange.

8. A cleaning device comprising:

a cleaning member removing a waste toner remaining on a surface of an image carrier; and the toner conveyance device according to claim 1, which conveys the waste toner removed by the cleaning member.

9. An image forming apparatus comprising the toner conveyance device according to claim 1 or the cleaning device according to claim 8.

* * * * *